US010945544B2

(12) United States Patent
Lee

(10) Patent No.: US 10,945,544 B2
(45) Date of Patent: Mar. 16, 2021

(54) PORTABLE TYPE PILLOW AND BLANKET KIT

(71) Applicant: Jong Hwan Lee, Daegu (KR)

(72) Inventor: Jong Hwan Lee, Daegu (KR)

( * ) Notice: Subject to any disclaimer, the term of this patent is extended or adjusted under 35 U.S.C. 154(b) by 151 days.

(21) Appl. No.: 15/924,294

(22) Filed: Mar. 19, 2018

(65) Prior Publication Data

US 2018/0263389 A1 Sep. 20, 2018

(30) Foreign Application Priority Data

Mar. 17, 2017 (KR) ..... 10-2017-0033824
Mar. 9, 2018 (KR) ..... 10-2018-0027823

(51) Int. Cl.

| | |
|---|---|
| ***A47G 9/10*** | (2006.01) |
| ***A47G 9/02*** | (2006.01) |
| ***A47G 9/04*** | (2006.01) |
| ***A47G 9/06*** | (2006.01) |
| *A47B 23/00* | (2006.01) |

(52) U.S. Cl.

CPC ..... *A47G 9/1045* (2013.01); *A47G 9/0223* (2013.01); *A47G 9/04* (2013.01); *A47G 9/06* (2013.01); *A47G 9/1027* (2013.01); *A47G 9/1081* (2013.01); *A47B 23/002* (2013.01)

(58) Field of Classification Search

CPC ..... A47G 9/1045; A47G 9/0223; A47G 9/06; A47G 9/1027; A47G 9/1081; A47B 23/002

See application file for complete search history.

(56) References Cited

U.S. PATENT DOCUMENTS

| | | | | |
|---|---|---|---|---|
| 4,345,345 A * | 8/1982 | Holtz | A47C 7/383 5/640 |
| 5,727,841 A * | 3/1998 | Morley | A47C 1/143 297/184.1 |
| 2011/0145994 A1* | 6/2011 | Pileggi | A47G 9/1081 5/655.3 |
| 2012/0011655 A1* | 1/2012 | Rojas | A47C 7/383 5/636 |
| 2013/0036554 A1* | 2/2013 | Steinmetz | A47C 20/025 5/631 |

FOREIGN PATENT DOCUMENTS

| | | | |
|---|---|---|---|
| GB | 1498661 * | 2/1975 | A47C 27/00 |
| KR | 20-0259037 Y1 | 1/2002 | |
| KR | 20-0330551 Y1 | 10/2003 | |
| KR | 10-1808156 B1 | 12/2017 | |

* cited by examiner

*Primary Examiner* — David R Hare
*Assistant Examiner* — Adam C Ortiz
(74) *Attorney, Agent, or Firm* — Revolution IP, PLLC

(57) ABSTRACT

A portable pillow and blanket kit includes a pillow cover which includes an opening/closing portion; a blanket which is put into the pillow cover through the opening/closing portion; a cover-shape changing member which includes a first end portion firmly coupled to the pillow cover, and a second end portion detachably coupled to an outer surface of the pillow cover and making the pillow cover be changed in shape; and a cushion member which is penetrated by and coupled to the cover-shape changing member, wherein the pillow cover includes a first air controller for inflating or deflating the pillow cover, and wherein the pillow cover includes a changing member detachable portion on the outer surface thereof to which the second end portion of the cover-shape changing member is detachably coupled.

18 Claims, 14 Drawing Sheets

(a)

(b)

(a)

(b)

(a)

(b)

(a)

(b)

(a)

(b)

PORTABLE TYPE PILLOW AND BLANKET KIT

CROSS-REFERENCE TO RELATED APPLICATION

This application claims priority from Korean Patent Applications No. 10-2017-0033824, filed on Mar. 17, 2017 and No. 10-2018-0027823, filed on Mar. 9, 2018 in the Korean Intellectual Property Office, the disclosures of which are incorporated herein by reference.

BACKGROUND OF THE INVENTION

(a) Field of the Invention

The present disclosure relates to a portable pillow and blanket kit, and more particularly to a portable pillow and blanket kit which is capable of keeping a blanket in a pillow cover, is easy to carry and use in accordance with places and situations since it is inflated and deflated by shape change of the pillow cover, and stably supports a body part by coupling a plurality of pillow covers.

(b) Description of the Related Art

With a recent increased demand for overseas trips and the like travel, travelers are likely to move for a long time in a fixed or uncomfortable posture, or occasionally have to take a rest or sleep in an ill-equipped place.

Therefore, the rest or sleep during the movement using a means of transportation or in uncomfortable environments may cause muscle rigidity, fatigue accumulation, and the like side effects to the travelers. To mitigate such side effects, various portable pillows such as a neck pillow, etc., a cushion, and a travel blanket are being developed or have been developed and marketed.

A traveling pillow available on the market is mostly a neck pillow shaped like a horse shoe and supporting a user's head and neck. In accordance with methods of having a shape and supporting force, there are a pillow having a fixed shape filled with a filler such as a memory foam, and an inflatable pillow having a shape and supporting force when inflated but having the minimum volume to be easily carried when deflated.

The foregoing neck pillow shaped like the horse shoe has been marketed in various forms from a neck pillow with a pocket capable of storing small stuffs such as a cellular phone at a lateral side thereof, to a neck pillow with a function of playing music.

Besides, there have been marketed various types of travel pillows such as an inflatable travel cushion capable of supporting a user's upper body corresponding to various sleeping postures, a cushion with a string or cable to fasten a user's upper body to a chair.

In case of a travel blanket, there have been marketed various types of blankets having waterproof, wind-breaking and the like special functions as well as a basic heat-retaining function for keeping a body temperature in an environment of making a temperature difference. However, to carry such a blanket, the blanket is generally carried as it is simply folded or rolled up and put together with other things into a bag, or packed in a dedicated pouch. In other words, the blanket is carried separately from the pillow.

The pillow and the blanket have to be purchased as necessary by an individual and always carried when other means of transportation than flights are used. When the pillow and the blanket available on the market are separately carried, inconvenience is caused as follows.

When an inflatable portable pillow is used for space utilization, it is impossible to change the shape of the pillow in accordance with a user's body types, tastes or objects unlike other pillows of the fixed-shape type using the filler. Further, when the portable pillow is not sufficiently inflated, it is difficult to provide a stable shape and supporting force as the pillow since an empty space inside the pillow is frequently changed in position according to the strength and positions of pressure applied from the outside and inner air is freely moved to the empty space according to the changed positions.

PRIOR ART LITERATURES

[Patent Document]

(Patent document 001) Korean Patent No. 10-1808156 (titled "TRAVEL PILLOW AND METHOD FOR STORING" and registered on Dec. 6, 2017)

SUMMARY OF THE INVENTION

Accordingly, the present disclosure is conceived to solve the foregoing problems, and an aspect of the present disclosure is to provide a portable pillow and blanket kit which is capable of keeping a blanket in a pillow cover, is easy to carry and use in accordance with places and situations since it is inflated and deflated by shape change of the pillow cover, and stably supports a body part by coupling a plurality of pillow covers.

In accordance with an embodiment of the present disclosure, there is provided a portable pillow and blanket kit including: a pillow cover which includes an opening/closing portion; a blanket which is put into the pillow cover through the opening/closing portion; a cover-shape changing member which includes a first end portion firmly coupled to the pillow cover, and a second end portion detachably coupled to an outer surface of the pillow cover and making the pillow cover be changed in shape; and a cushion member which is penetrated by and coupled to the cover-shape changing member, wherein the pillow cover includes a first air controller for inflating or deflating the pillow cover, and wherein the pillow cover includes a changing member detachable portion on the outer surface thereof to which the second end portion of the cover-shape changing member is detachably coupled.

In accordance with another embodiment of the present disclosure, there is provided a portable pillow and blanket kit including: a pillow cover which includes an opening/closing portion; a blanket which is put into the pillow cover through the opening/closing portion; a second air tube which is arranged inside the pillow cover; a cover-shape changing member which includes a first end portion firmly coupled to the pillow cover, and a second end portion detachably coupled to an outer surface of the pillow cover and making the pillow cover be changed in shape; and a cushion member which is penetrated by and coupled to the cover-shape changing member, wherein the second air tube includes a second air controller for inflating or deflating the second air tube, and wherein the pillow cover includes a changing member detachable portion on the outer surface thereof to which the second end portion of the cover-shape changing member is detachably coupled.

The portable pillow and blanket kit may further include a first air tube which is arranged inside the pillow cover and communicating with the first air controller.

The first air tube may include a first tube and a second tube, the first tube and the second tube may be configured to at least partially communicate with each other through a first air channel, and air in the first tube and the second tube may be movable through the first air channel.

The second air tube may include a fifth tube and a sixth tube, the fifth tube and the sixth tube may be configured to at least partially communicate with each other through a second air channel, and air in the fifth tube and the sixth tube may be movable through the second air channel.

The cover-shape changing member and the changing member detachable portion may include hook and loop fasteners and are coupled to each other in a form of the hook and loop fasteners.

The cover-shape changing member may include a first cover-shape changing member detachably coupled to a first area of the pillow cover, and a second cover-shape changing member detachably coupled to a second area of the pillow cover.

The pillow cover may include a first pillow cover and a second pillow cover, the first pillow cover may be capable of accommodating the second pillow cover therein, and the first pillow cover and the second pillow cover may be formed to be different in size from each other.

The pillow cover may include a first pillow cover and a second pillow cover, the second air tube may include a first type air tube arranged inside the first pillow cover, and a second type air tube arranged inside the second pillow cover, the first pillow cover may be capable of accommodating the second pillow cover therein, and the first pillow cover and the second pillow cover may be formed to be different in size from each other.

The pillow cover may include a first pillow cover and a second pillow cover, the second air tube may include a third type air tube arranged inside the first pillow cover and a fourth type air tube arranged inside the second pillow cover, the first pillow cover may be capable of accommodating the second pillow cover therein, and the first pillow cover and the second pillow cover may be formed to be different in size from each other.

The pillow cover may include a pillow cover coupler for coupling with another portable pillow and blanket kit, and the pillow cover coupler may be provided in singular or plural.

The pillow cover may be made of an airproof material.

The opening/closing portion may include an airproof opening/closing element.

The pillow cover may include a pillow cover fastener configured to fasten the pillow cover to an external structure.

The pillow cover may include a grip to be gripped by a user.

The pillow cover may include a storage space.

BRIEF DESCRIPTION OF THE DRAWINGS

The above and/or other aspects of the present disclosure will become apparent and more readily appreciated from the following description of the exemplary embodiments, taken in conjunction with the accompanying drawings, in which.

DETAILED DESCRIPTION

Below, exemplary embodiments, in which an aspect of the present disclosure can be concretely materialized, will be described with reference to the accompanying drawings. In terms of describing the embodiments, like numerals refer to like elements, and repetitive descriptions thereof will be avoided as necessary.

A portable pillow and blanket kit according to a first embodiment of the present disclosure will be described with reference to FIGS. 1 to 5.

As shown in FIGS. 1 to 5, the portable pillow and blanket kit according to the present disclosure includes a pillow cover 1100, a blanket 1200, a cover-shape changing member 1130, and a cushion member 1400.

Figure 1:
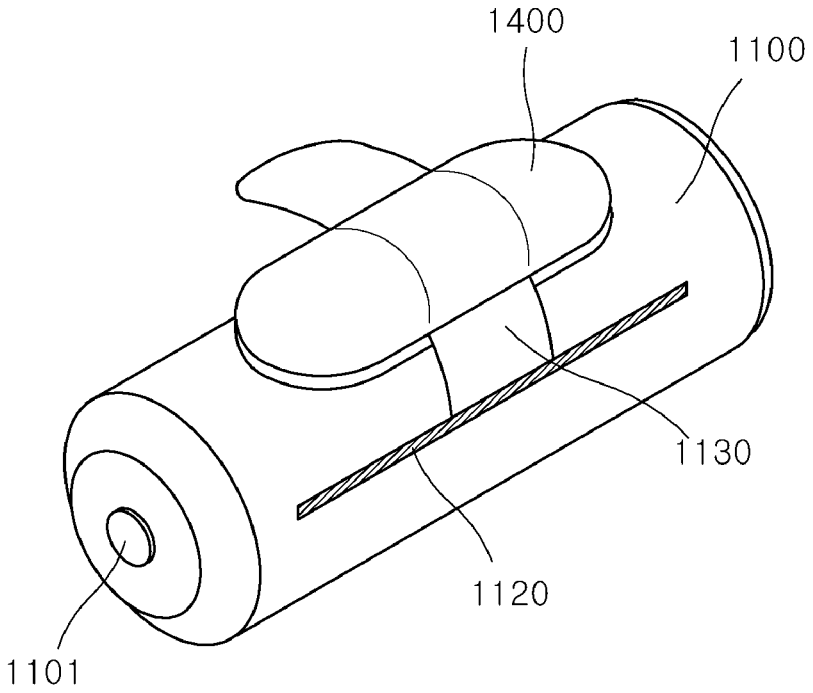
FIG. 1 schematically illustrates a portable pillow and blanket kit according to a first embodiment of the present disclosure.
Figure 2:
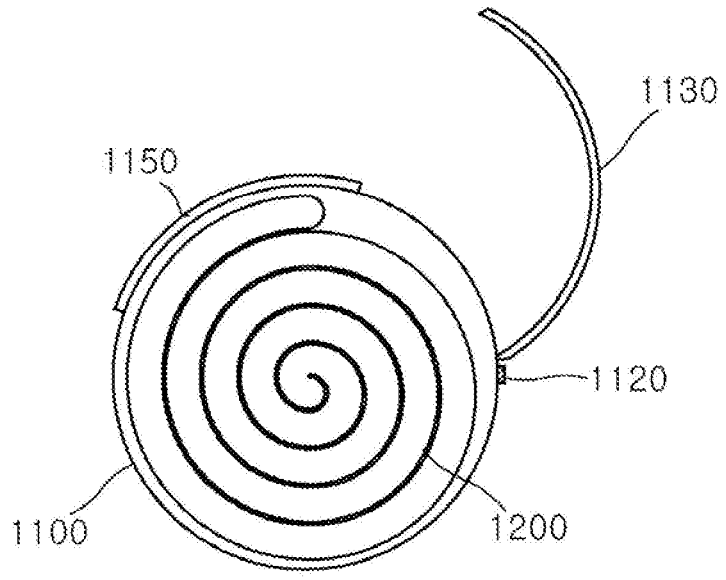
FIG. 2 illustrates a cross-section of the portable pillow and blanket kit of FIG. 1.
Figure 2:
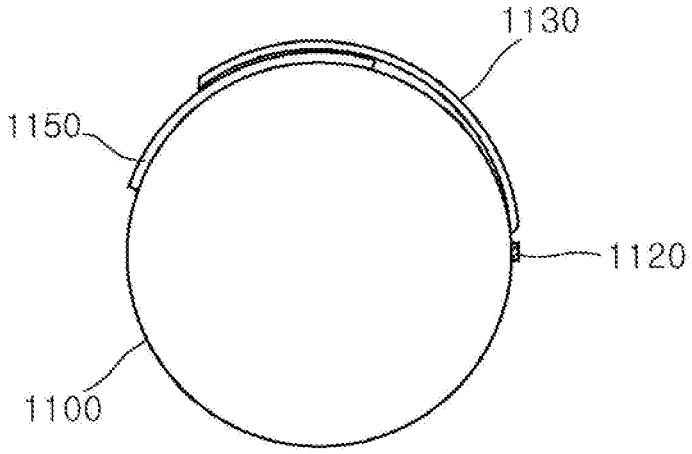

Referring to FIG. 1, the pillow cover 1100 is formed with an opening/closing portion 1120 and a first air controller 1101. The pillow cover 1100 is made of an airproof material such as sealed waterproof nylon, a polyvinyl chloride (PVC) fabric, etc.

The opening/closing portion 1120 opens or closes the pillow cover 1100 so that the blanket 1200 can be inserted in the pillow cover 1100 or the blanket 1200 can be taken out of the pillow cover 1100.

Further, the opening/closing portion 1120 includes an airproof opening/closing element. For example, the opening/closing element may be achieved by a PROSEAL zipper. Further, the opening/closing portion 1120 may have a structure of being rolled and folded up many times, and fastened with a buckle so as to prevent air from being injected or leaking through the opening/closing portion 1120.

The first air controller 1101 may control the pillow cover 1100 to be inflated or deflated. As shown in (b) of FIG. 2, the pillow cover 1100 is inflated to have supporting force through the first air controller 1101 after closing the opening/closing portion 1120 in a state that the blanket 1200 is removed from the pillow cover 1100, so that a user can freely use the pillow cover 1100 as a pillow or a cushion.

Further, the pillow cover 110 can have the minimum volume by discharging air through the first air controller 1101 when the blanket 1200 is inserted in the pillow cover 1100, so that a user can easily carry the pillow cover 110.

The blanket 1200 may be inserted in the pillow cover 1100 through the opening/closing portion 1120, in which the blanket 1200 may include a general blanket or an electric blanket and the like functional blanket.

The cover-shape changing member 1130 includes a first end portion firmly coupled to the pillow cover 1100, and a second end portion detachably coupled to an outer surface of the pillow cover 1100 as shown in FIGS. 1 to 4.

In accordance with positions where the cover-shape changing member 1130 is attached to the pillow cover 1100, the cross-section of the pillow cover 1100 is varied in diameter, thereby changing the shape of the pillow cover 1100. To make the cover-shape changing member 1130 be attached to or detached from the outer surface of the pillow cover 1100, a changing member detachable portion 1150 is formed on the outer surface of the pillow cover 1100.

Figure 4:
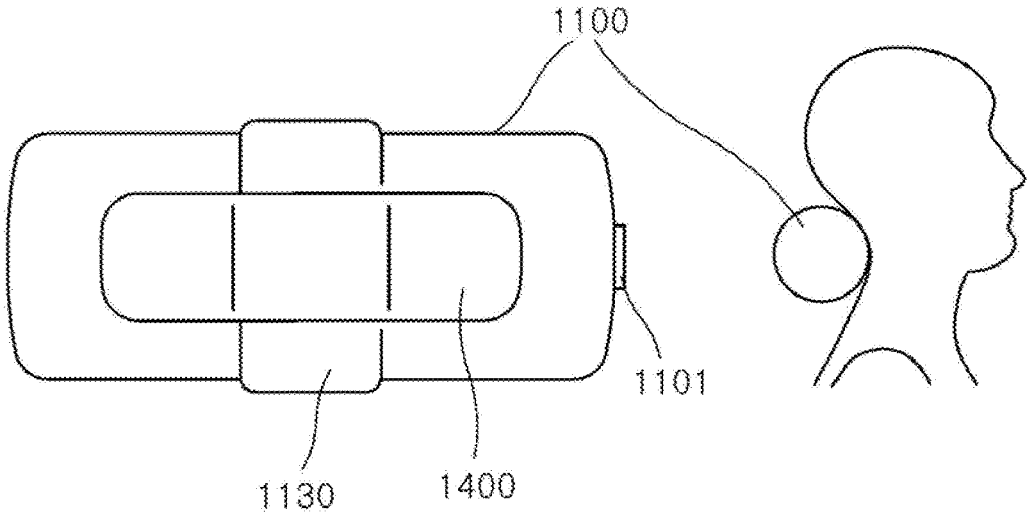
FIG. 4 schematically illustrates an example of using the cover-shape changing member in the portable pillow and blanket kit of FIG. 1.
Figure 4:
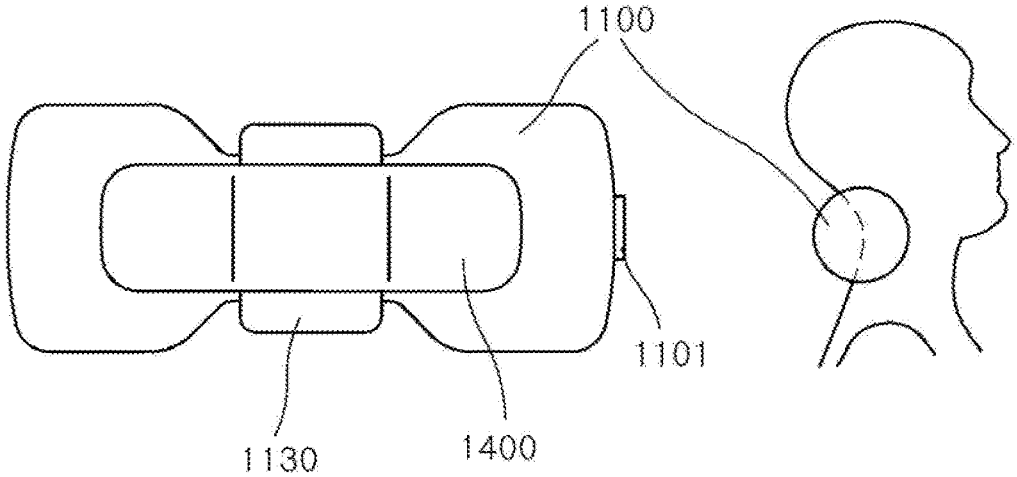

That is, as shown in FIG. 4, a user may use the cover-shape changing member 1130 to freely adjust the diameter of the pillow cover 110 before injecting air into the pillow cover 1100 through the first air controller 1101, thereby changing the shape of the pillow cover 1100.

Since the shape of the pillow cover 1100 is changeable through the cover-shape changing member 1130 as desired by a user, the user can use the portable pillow and blanket kit according to the present disclosure in accordance with his/her body types, tastes and objects.

The cover-shape changing member 1130 and the changing member detachable portion 1150 may be materialized by hook and loop fasteners such as Velcro. However, the cover-shape changing member 1130 and the changing member detachable portion 1150 according to the present disclosure are not limited to the hook and loop fasteners. Alternatively, a snap fastener, a hook, a button, etc. may be used.

Further, the cover-shape changing member 1130 may include a first cover-shape changing member 1131, a second cover-shape changing member 1132 and a third cover-shape changing member 1133 in accordance with the attaching positions of the pillow cover 1100.

Figure 5:
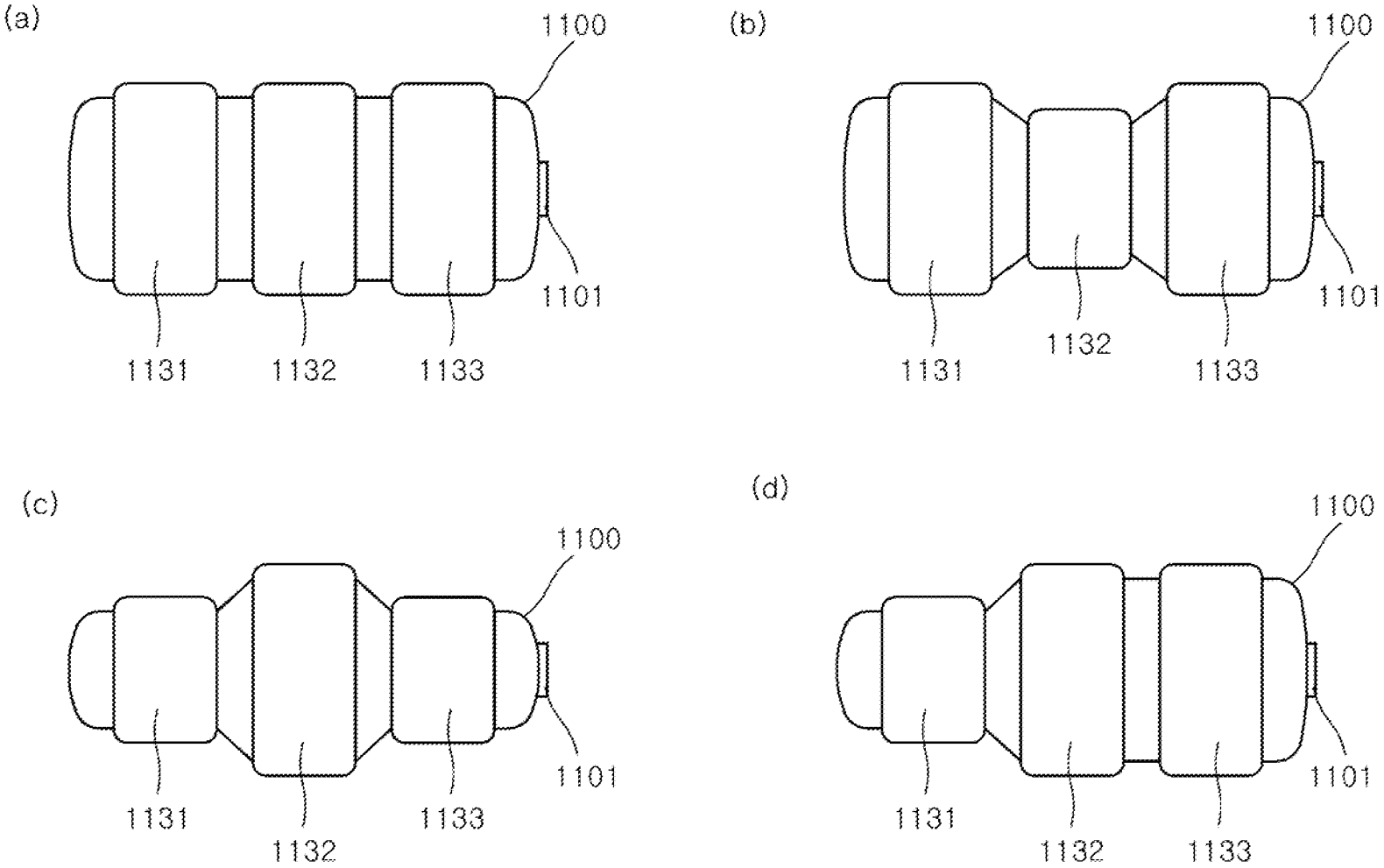
FIG. 5 schematically illustrates embodiments of the cover-shape changing member in the portable pillow and blanket kit of FIG. 1.

As shown in (a) of FIG. 5, the first cover-shape changing member 1131 is arranged in a first area of the pillow cover 1100, the second cover-shape changing member 1132 is arranged in a middle area of the pillow cover 1100, and the third cover-shape changing member 1133 is arranged in a second area of the pillow cover 1100.

As shown in (b) to (d) of FIG. 5, the pillow cover 1100 may have various shapes as desired by a user through the first to third cover-shape changing members 1131 to 1133, so that the user can use the portable pillow and blanket kit according to the present disclosure in accordance with his/her body types, tastes and objects.

The cushion member 1400 is penetrated by and coupled to the cover-shape changing member 1130.

Figure 3:
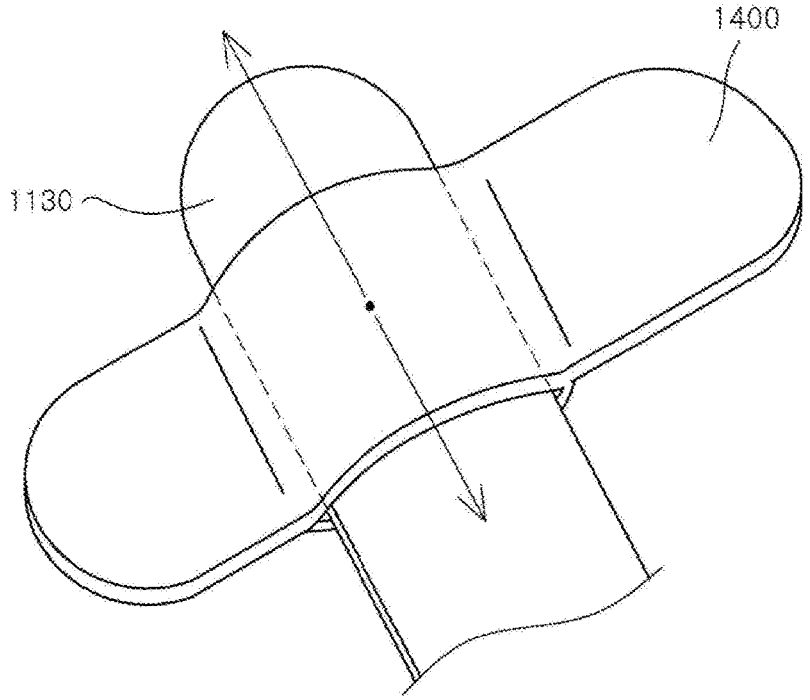
FIG. 3 illustrates a cover-shape changing member and a cushion member in the portable pillow and blanket kit of FIG. 1.
Figure 3:
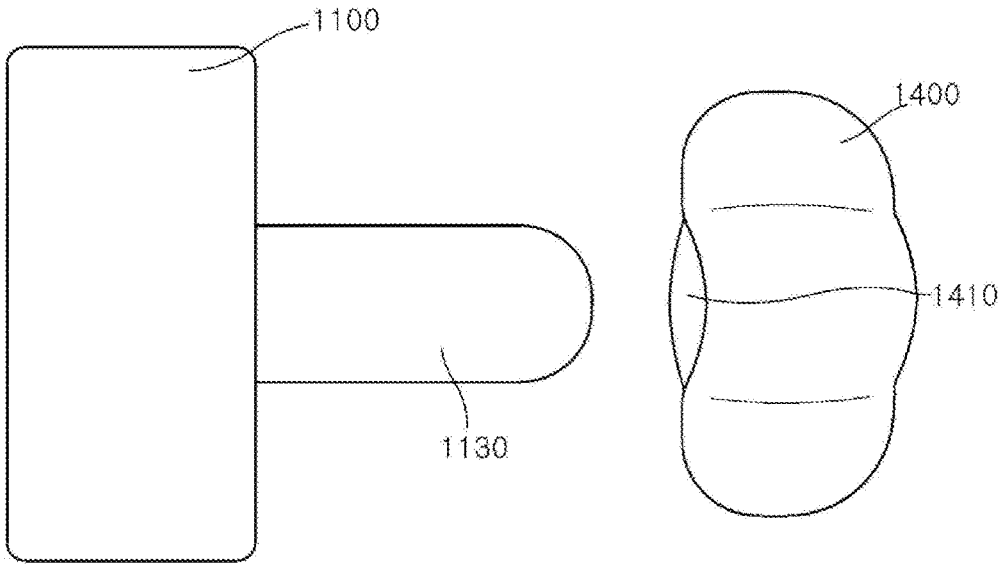

Specifically, as shown in FIG. 3, the cushion member 1400 is formed with a changing member insertion hole 1410 in the middle thereof. As the cover-shape changing member 1130 passes through the changing member insertion hole 1410 and is fitted to the cushion member 1400, the cover-shape changing member 1130 and the cushion member 1400 are coupled to each other.

By coupling the cover-shape changing member 1130 and the cushion member 1400, a user is allowed to freely change the outer shape of the pillow cover 110 in accordance with usage. Thus, it is possible to more efficiently use the pillow cover 1100.

As the cover-shape changing member 1130 is fitted to the cushion member 1400 and attached and coupled to the changing member detachable portion 1150, it is more convenient for a user to use the portable pillow and blanket kit since the cushion member 1400 is prevented from being separated from the pillow cover 1100 while the user uses the portable pillow and blanket kit.

Further, the cushion member 1400 is formed long in a longitudinal direction as shown in FIG. 1, FIG. 3 and FIG. 4 and coupled to the cover-shape changing member 1130 as arranged in the same direction as the lengthwise direction of the pillow cover 1100. Besides, the cushion member 1400 may have various shapes such as a circular shape, a polygonal shape, etc. and be coupled to the cover-shape changing member 1130, so that the pillow cover 1100 can be freely changed in outer shape.

Of course, the cushion member 1400 may be separated from the cover-shape changing member as shown in FIG. 5. In this case, the cushion member 1400 may be stored in an inner space of the pillow cover 1100.

However, coupling between the cushion member 1400 and the cover-shape changing member 1130 according to the present disclosure is not limited to this embodiment. Alternatively, the cover-shape changing member 1130 may be formed with a coupling hole (not shown), through which the cushion member 1400 passes to couple with the cover-shape changing member 1130.

Below, a portable pillow and blanket kit according to a second embodiment of the present disclosure will be described with reference to FIGS. 6 to 15.

Like those of the foregoing first embodiment, the portable pillow and blanket kit according to this embodiment includes a pillow cover 2100 and a blanket 2200; the volume of the pillow cover 2100 is changed by a first air controller 2101 formed in the pillow cover 2100; the shape of the pillow cover 2100 is changed by adjusting a cross-sectional diameter of the pillow cover 2100 through a cover-shape changing member 2130; and the cover-shape changing member 2130 couples with a cushion member 2400. Thus, repetitive descriptions will be avoided as necessary.

However, the portable pillow and blanket kit according to the second embodiment includes a first air tube 2300 unlike the first embodiment.

Figure 6:
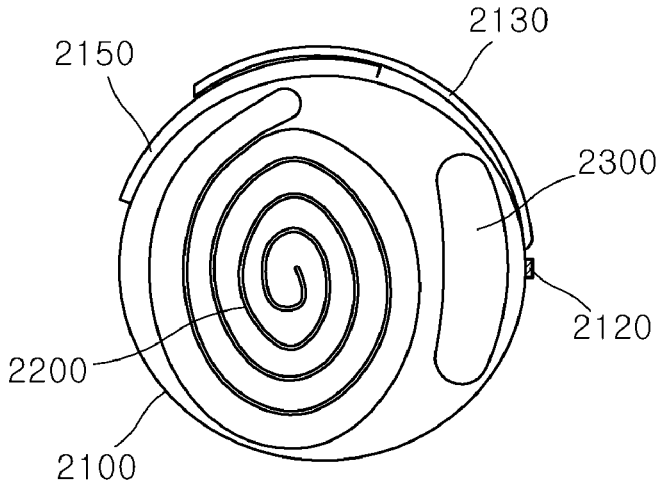
FIG. 6 schematically illustrates a portable pillow and blanket kit according to a second embodiment of the present disclosure.
Figure 7:
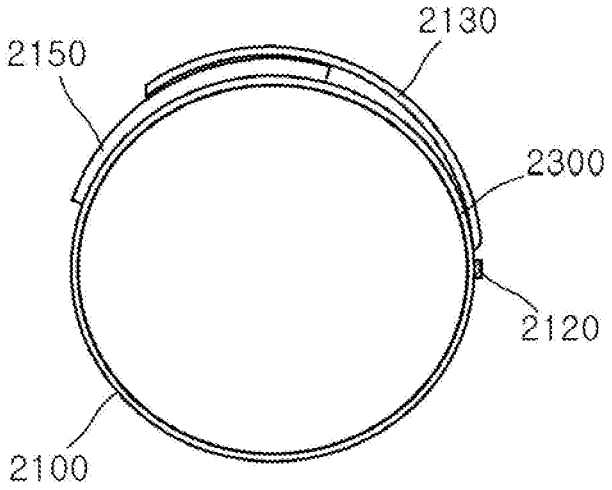
FIG. 7 illustrates a cross-section of the portable pillow and blanket kit of FIG. 6.
Figure 7:
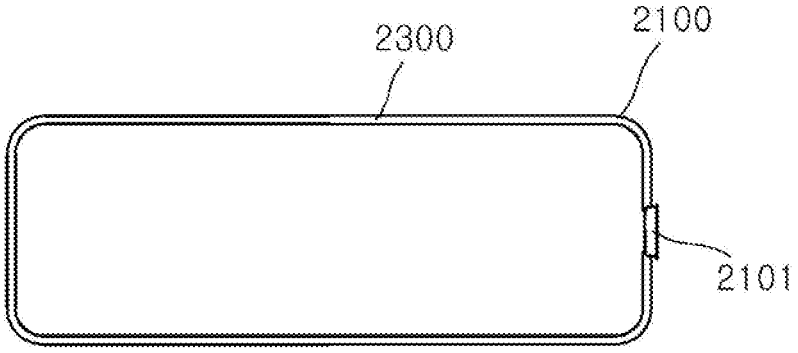
Figure 8:
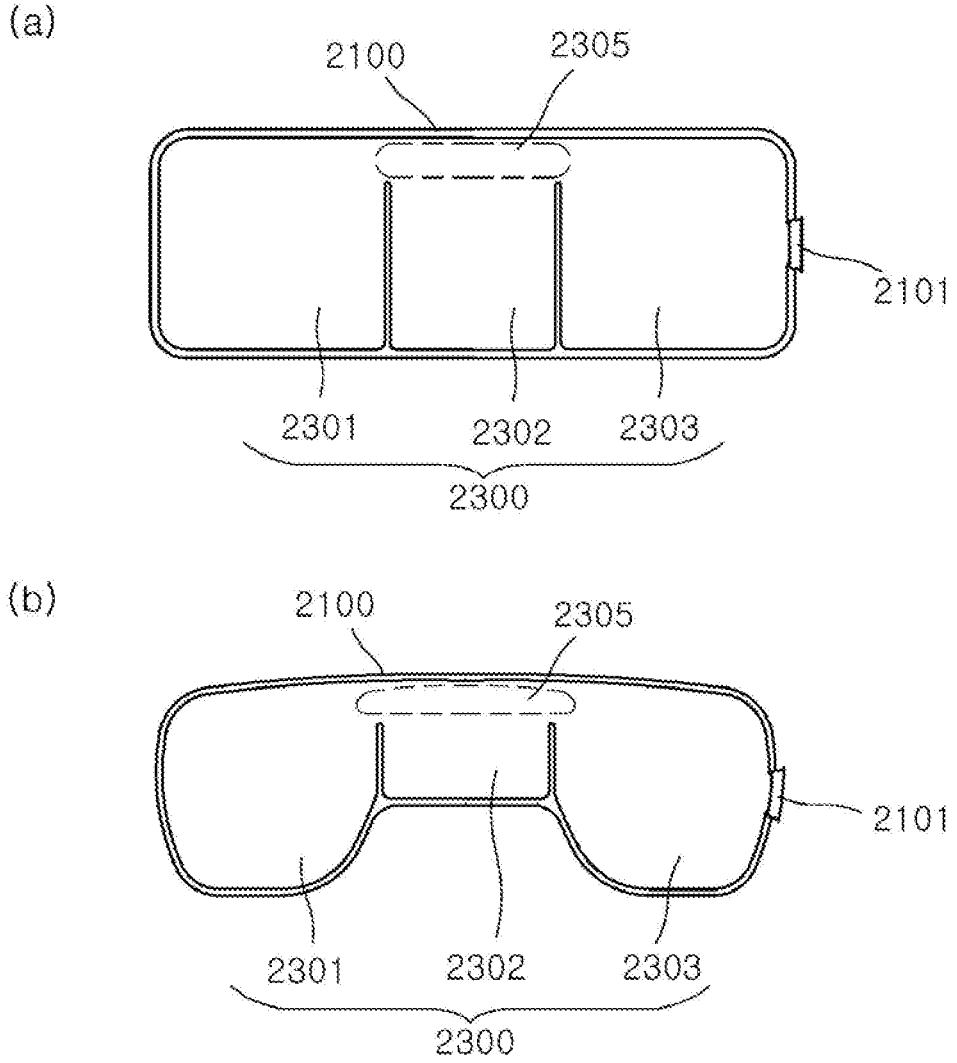
FIG. 8 illustrates embodiments of an air tube in the portable pillow and blanket kit of FIG. 6.

As shown in FIGS. 6 to 8, the first air tube 2300 is arranged inside the pillow cover 2100, connected to the first air controller 2101, and made of an airproof material.

That is, when air is injected through the first air controller 2101 so as to inflate the pillow cover 2100 in a state that the blanket 2200 is removed from the pillow cover 2100, the air is supplied to the first air tube 2300 through the first air controller 2101 so that the volume of the first air tube 2300 can be expanded, thereby increasing the volume of the pillow cover 2100.

In this case, the pillow cover 2100 may have an aerating material, thereby having an improved aesthetic effect with various designs and patterns.

Further, the first air tube 2300 may include a first tube 2301, a second tube 2302 and a third tube 2303 as shown in FIG. 8.

The first tube 2301, the second tube 2302 and the third tube 2303 are formed to have individual spaces, and the first tube 2301, the second tube 2302 and the third tube 2303 are configured to at least partially communicate with one another through a first air channel 2305.

That is, air is movable via the first air channel 2305 in accordance with positions of the first air tube 2300 pressed by a user. For example, when a user presses the second tube 2302, the air in the second tube 2302 moves to the first tube 2301 and the third tube 2303 via the first air channel 2305 and changes the shape of the first air tube 2300, so that the user can use the portable pillow and blanket kit according to the present disclosure in accordance with his/her body types, tastes and objects.

The first tube 2301, the second tube 2302 and the third tube 2303 may be manufactured to have the same size with one another as shown in (a) of FIG. 8, or may have different sizes from one another. As shown in (b) of FIG. 8, the cover-shape changing member 2130 may be used to change the volumes of the first tube 2301, the second tube 2302 and the third tube 2303.

Like the foregoing first air tube 2300, a second air tube 3300 to be described later (see FIG. 16) may include a fifth tube, a sixth tube, a seventh tube and a second air channel. The fifth tube, the sixth tube, the seventh tube and the second air channel are equivalent to the first tube 2301, the second tube 2302, the third tube 2303 and the first air channel 2305, and thus repetitive descriptions thereof will be avoided.

Figure 9:
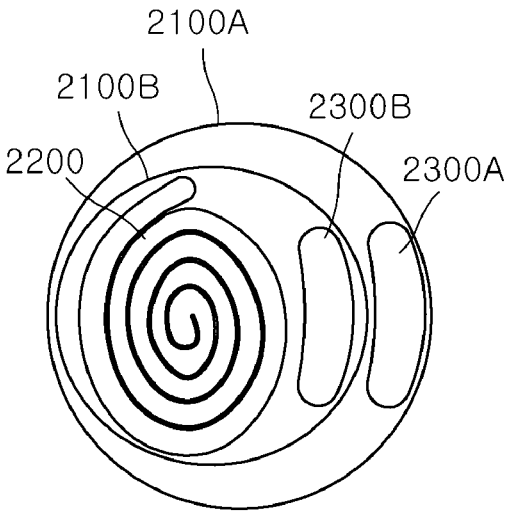
FIG. 9 illustrates a first pillow cover, a second pillow cover, a first type air tube and a second type air tube in the portable pillow and blanket kit of FIG. 6.
Figure 10:
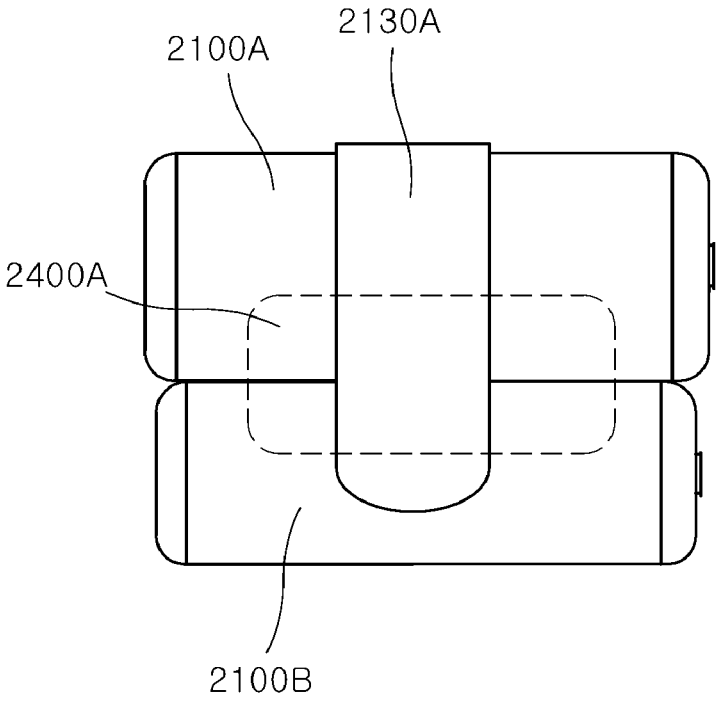
FIG. 10 illustrates combination of the first pillow cover and the second pillow cover in the portable pillow and blanket kit of FIG. 9.
Figure 11:
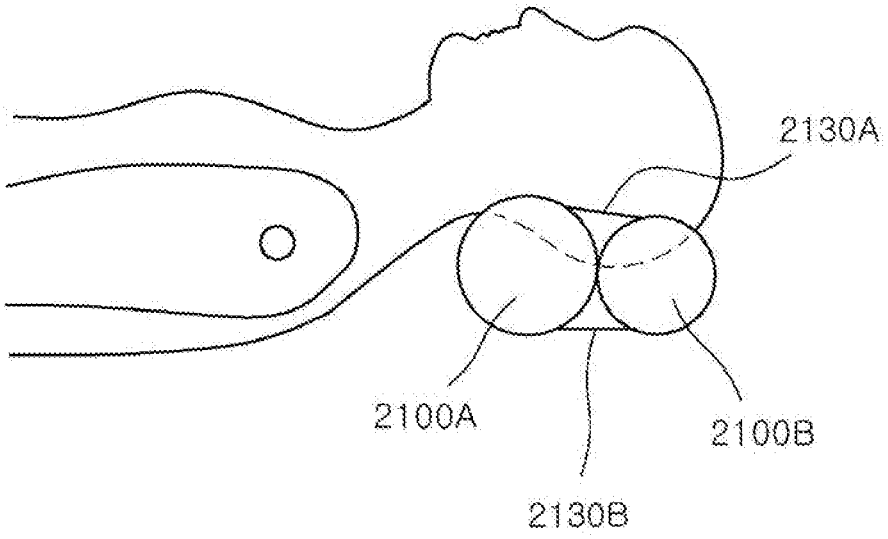
FIG. 11 illustrates an example that a user uses the portable pillow and blanket kit of FIG. 10.
Figure 11:
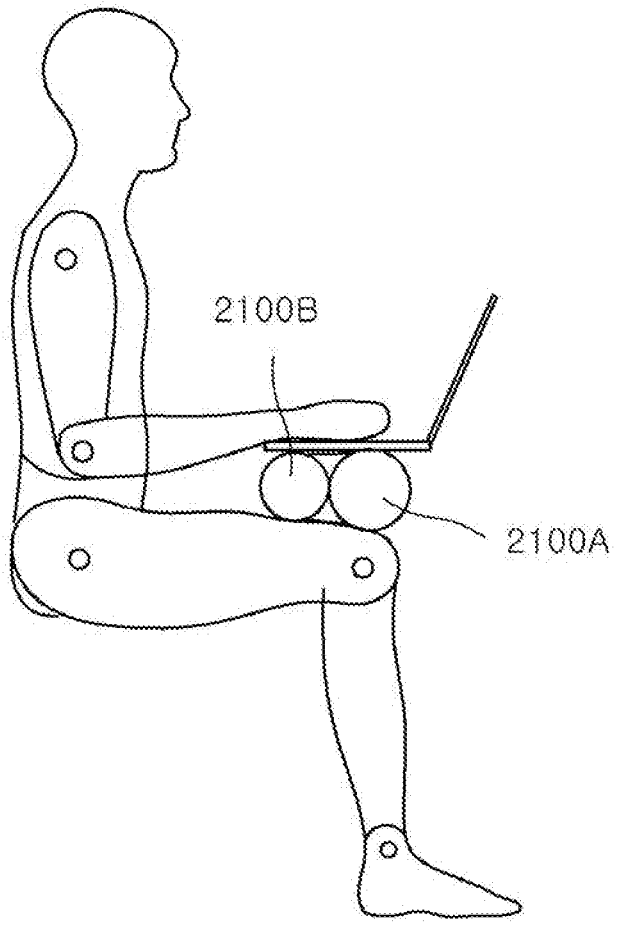

Further, as shown in FIGS. 9 to 11, the pillow cover 2100 of the portable pillow and blanket kit in the tis embodiment includes a first pillow cover 2100A and a second pillow cover 2100B. The first air tube 2300 may include a first type air tube 2300A and a second type air tube 2300B.

First, as shown in FIG. 9, the second pillow cover 2100B may be accommodated inside the first pillow cover 2100A, and the first pillow cover 2100A is bigger than the second pillow cover 2100B.

The first type air tube 2300A is arranged inside the first pillow cover 2100A, and the second type air tube 2300B is arranged inside the second pillow cover 2100B, thereby increasing the volumes of the first pillow cover 2100A and the second pillow cover 2100B.

As shown in FIG. 10, the second pillow cover 2100B is taken out of the first pillow cover 2100A, and the first type air tube 2300A and the second type air tube 2300B are respectively expanded to increase the volumes of the first pillow cover 2100A and the second pillow cover 2100B.

In this case, cover-shape changing members 2130A, 2130B of the first pillow cover 2100A and the second pillow cover 2100B are respectively coupled to the second pillow cover 2100B and the first pillow cover 2100A so as to be formed as a single large pillow or cushion and utilized as shown in FIG. 11.

Of course, the second pillow cover 2100B is arranged inside the first pillow cover 2100A, and either of the first type air tube 2300A or the second type air tube 2300B is expanded so that the volume of the first pillow cover 2100A or the second pillow cover 2100B can be increased to be used as one pillow.

Figure 12:
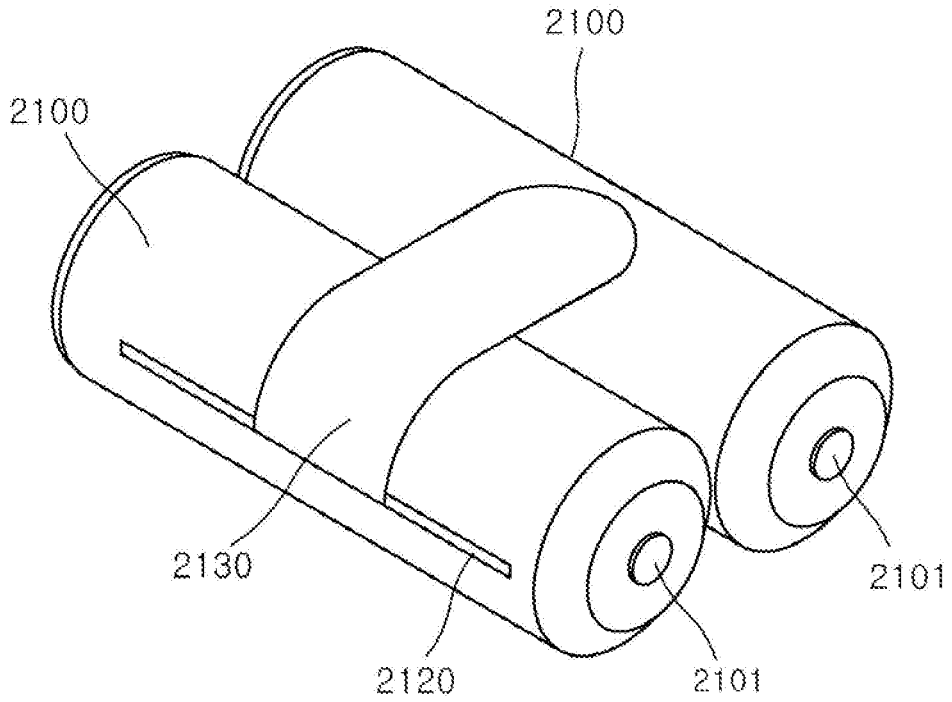
FIG. 12 illustrates that the portable pillow and blanket kits of FIG. 6 is provided in plural and the plurality of portable pillow and blanket kits.

Further, as shown in FIG. 12, the portable pillow and blanket kit according to the present disclosure is provided in plural, so that the cover-shape changing members 2130 can be cross-coupled to the plurality of pillow covers 2100. Thus, the portable pillow and blanket kit according to the present disclosure can be more widely used.

In this regard, although it is not illustrated, the pillow cover 2100 may be provided with a pillow cover coupler (not shown) to couple with another portable pillow and blanket kit, for example, to make a plurality of pillow covers 2100 be coupled with one another. The pillow cover coupler can make the pillow covers 2100 be coupled to each other.

The pillow cover coupler may be formed with a Velcro surface, or may be shaped like a string to be coupled to a projection (not shown) provided in the pillow cover coupler. However, there are no limits to the pillow cover coupler. Alternatively, the pillow cover coupler may have any structure such as a band or the like as long as it can make the plurality of pillow covers 2100 be coupled to and separated from one another.

Further, the pillow cover coupler may be also applied to the portable pillow and blanket kit according to the first embodiment of the present disclosure.

Figure 13:
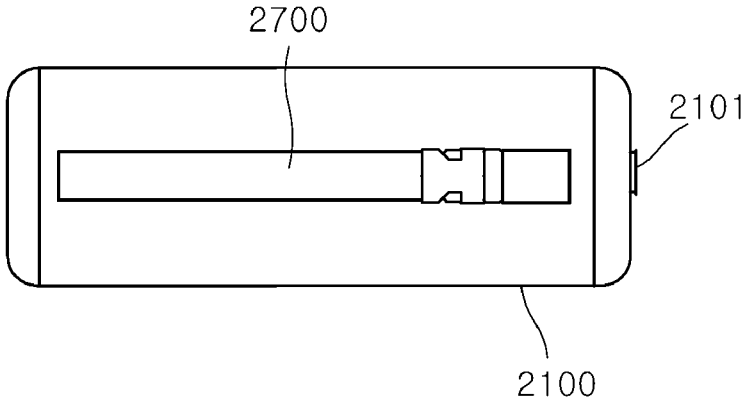
FIG. 13 illustrates a fastener in the portable pillow and blanket kit of FIG. 6.

Referring to FIG. 13, the portable pillow and blanket kit according to this the embodiment further includes a pillow cover fastener 2700.

The pillow cover fastener 2700 is provided on the outer surface of the pillow cover 2100 so that the pillow cover 2100 can be fastened to an external structure. The pillow cover fastener 2700 may be materialized by an adjustable band as shown in FIG. 13, or an elastic band.

Further, the pillow cover fastener 2700 may be also applied to the portable pillow and blanket kit according to the first embodiment of the present disclosure.

Figure 14:
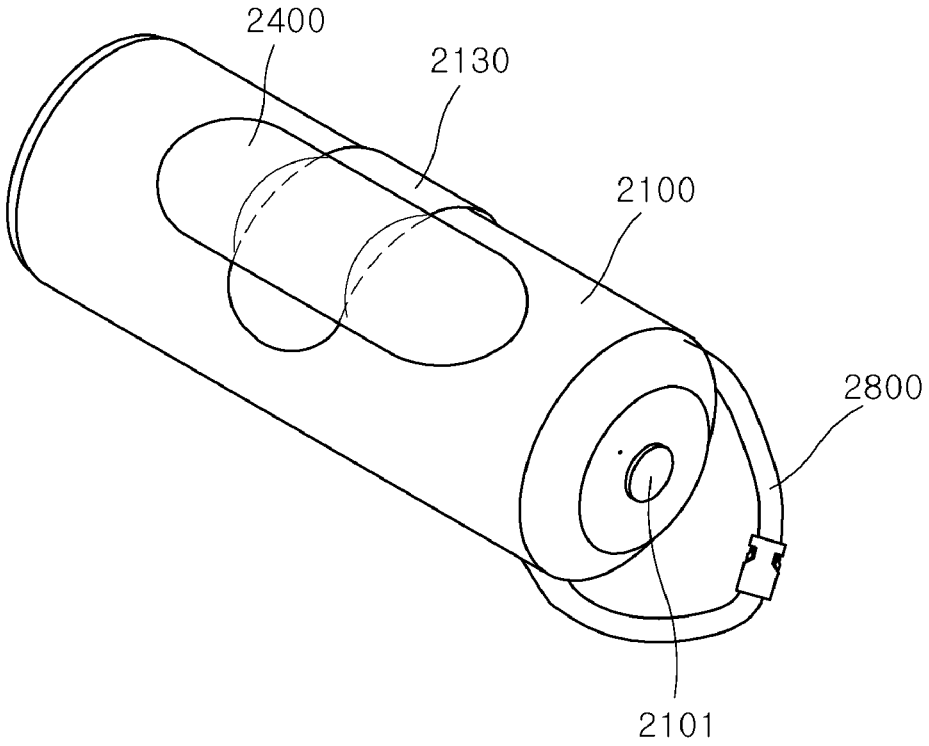
FIG. 14 illustrates a grip in the portable pillow and blanket kit of FIG. 6.

Referring to FIG. 14, the portable pillow and blanket kit according to this the embodiment further includes a grip 2800.

The grip 2800 is provided on the outer surface of the pillow cover 2100 so that a user can easily grip the pillow cover 2100. The grip 2800 may be also applied to the portable pillow and blanket kit according to the first embodiment of the present disclosure.

Figure 15:
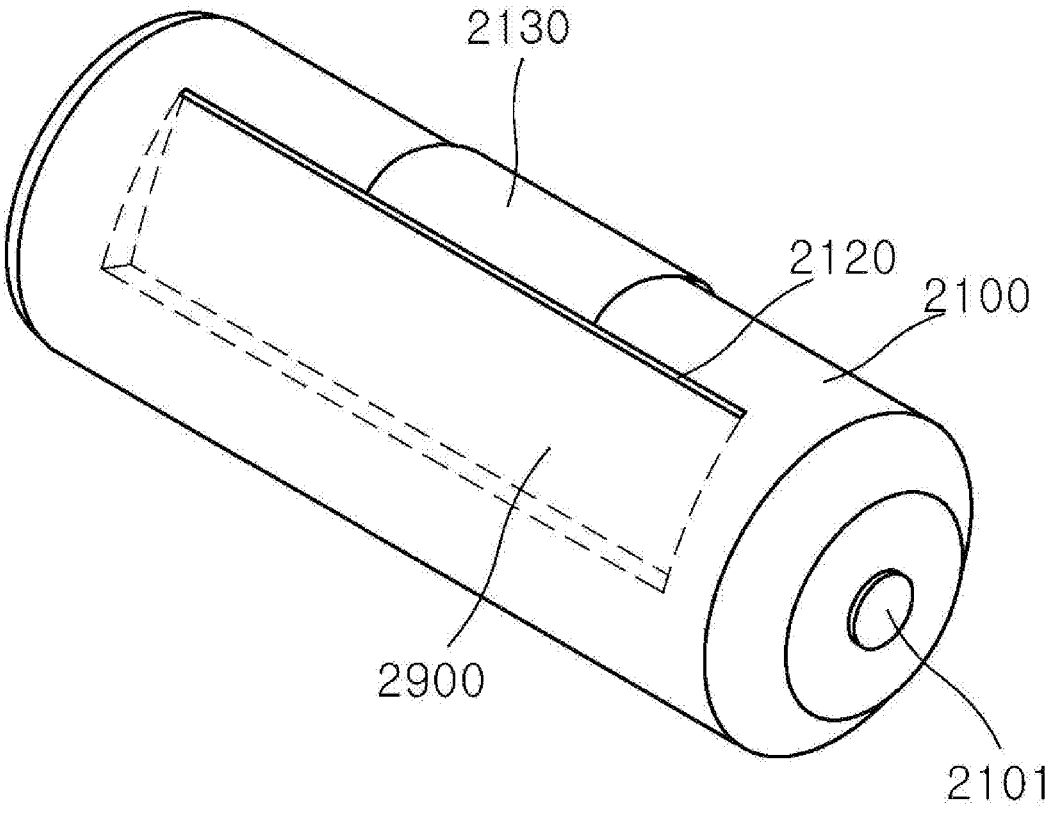
FIG. 15 illustrates a storage space in the portable pillow and blanket kit of FIG. 6.

Referring to FIG. 15, the portable pillow and blanket kit according to the present disclosure further includes a storage space 2900.

The storage space 2900 is formed inside or outside the pillow cover 2100. Thus, the pillow cover fastener 2700 detached from the pillow cover 2100, the pillow cover coupler or a user's personal items may be stored in the storage space 2900. The storage space 2900 may be also applied to the portable pillow and blanket kit according to the first embodiment of the present disclosure.

Figure 16:
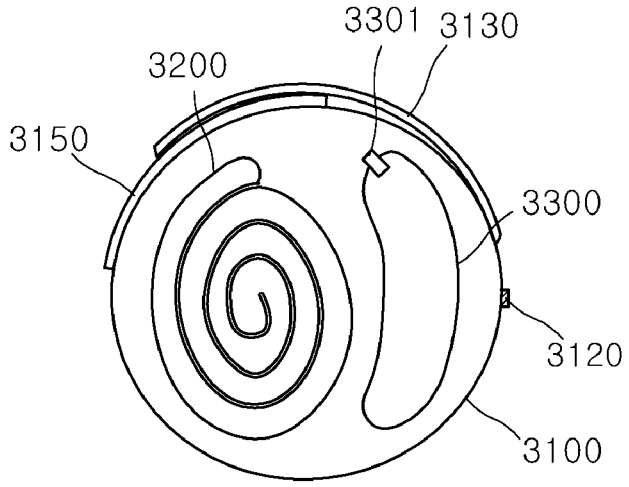
FIG. 16 illustrates a portable pillow and blanket kit according to a third embodiment of the present disclosure.
Figure 16:
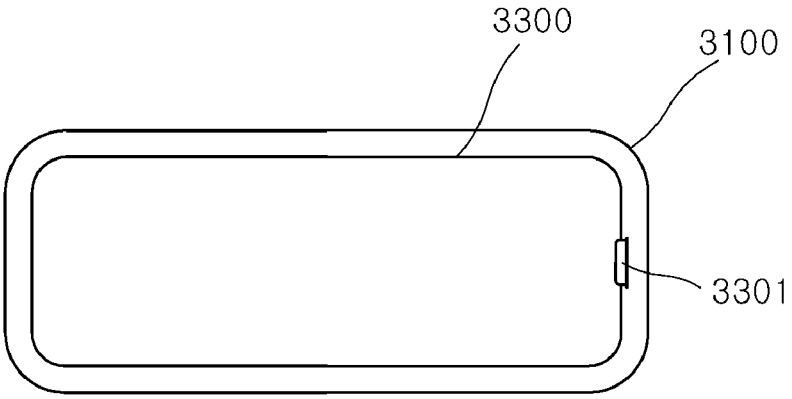

Below, a portable pillow and blanket kit according to a third embodiment of the present disclosure will be described with reference to FIG. 16.

Like those of the foregoing second embodiment, the portable pillow and blanket kit according to this embodiment includes a pillow cover 3100, a blanket 3200 and a second air tube 3300; the shape of the pillow cover 3100 is changed by adjusting a cross-sectional diameter of the pillow cover 3100 through a cover-shape changing member 3130; and the cover-shape changing member couples with a cushion member. Thus, repetitive descriptions will be avoided as necessary.

On the other hand, the second air tube 3300 in the portable pillow and blanket kit according to this embodiment includes a second air controller 3301.

That is, the second air tube 3300 and the pillow cover 3100 are provided independently of each other and do not couple with each other, and therefore the second air controller 3301 for inflating or deflating the second air tube 3300 is not coupled to the pillow cover 3100.

Thus, the second air tube 3300 is expanded through the second air controller 3301 so that the pillow cover 3100 can be increased in volume to be used by a user as a pillow or a cushion.

Besides, the second air tube 3300, the cover-shape changing member, the cushion member, the pillow cover coupler, the pillow cover fastener, the grip, and the storage space have the same structures as those of the second embodiment, and therefore repetitive descriptions thereof will be avoided.

The portable pillow and blanket kit according to the present disclosure has effects as follows.

First, the blanket is stored in the pillow cover, and the pillow cover is inflated to form the shape of the pillow to thereby reduce the total volume.

Second, the shape of the pillow cover is freely changeable through the cover-shape changing member in accordance with a user's body types, tastes or objects, so that the user can feel more stable.

Third, the air tube includes the first tube and the second tube, and the air is movable in the first tube and the second tube through the air channel, thereby providing a stable shape and support force of the pillow in accordance with a user's body types or objects.

Fourth, the plurality of pillow covers are provided to be simultaneously used for many body parts of a user, or may be usable as the pillow or cushion for many people.

Fifth, the plurality of pillow covers are provided and coupled to be used as a large pillow.

Sixth, the plurality of pillow covers are formed to be different in size from one another, and therefore a user may freely select the plurality of pillow covers in accordance with the shapes of his/her body part or may combine and use the plurality of pillow covers as a large pillow or cushion.

Although a few exemplary embodiments of the present disclosure have been shown and described, these are for illustrative purpose only and it will be appreciated by those skilled in the art that changes may be made in these embodiments without departing from the principles and spirit of the invention, the scope of which is defined in the appended claims and their equivalents.

REFERENCE NUMERALS

1100, 2100, 3100: pillow cover
2100A: first pillow cover
2100B: second pillow cover
1101, 2101: first air controller
1120, 2120, 3120: opening/closing portion
1130, 2130, 3130, 2130A, 2130B: cover-shape changing member
1131: first cover-shape changing member
1132: second cover-shape changing member
1133: third cover-shape changing member
1150, 2150, 3150: changing member detachable portion
1200, 2200, 3200: blanket
2300: first air tube
3300: second air tube
2300A: first type air tube
2300B: second type air tube
3301: second air controller
2301: first tube
2302: second tube
2303: third tube
2305: first air channel
1400, 2400, 2400A, 2400B: cushion member
1410: changing member insertion hole
2700: pillow cover fastener
2800: grip
2900: storage space

What is claimed is:

1. A portable pillow and blanket kit comprising:

a pillow cover which comprises an opening/closing portion;

a blanket which is put into the pillow cover through the opening/closing portion;

a cover-shape changing member which comprises a first end portion coupled to the pillow cover, and a second end portion configured as a free end, which is detachably coupled to an outer surface of the pillow cover and making the pillow cover be changed in shape; and a cushion member which is penetrated by the cover-shape changing member, wherein the cover-shape changing member is configured to couple to and be separated from the cushion member, wherein the pillow cover comprises a first air controller configured to inflate or deflate the pillow cover, wherein the pillow cover comprises a changing member detachable portion on the outer surface thereof to which the second end portion of the cover-shape changing member is detachably coupled, wherein a single changing member insertion hole is formed in a middle of the cushion member, the cover-shape changing member configured to be inserted into the single changing member insertion hole, wherein the cover-shape changing member is configured to pass through the single changing member insertion hole so that the cover-shape changing member and the cushion member are coupled to each other, or the cover-shape changing member is configured to be separated from the cushion member upon removing the cushion member from the cover-shape changing member.

2. The portable pillow and blanket kit according to claim 1, further comprising a first air tube which is arranged inside the pillow cover and communicating with the first air controller.

3. The portable pillow and blanket kit according to claim 2, wherein:

the first air tube comprises a first tube and a second tube, the first tube and the second tube are configured to at least partially communicate with each other through a first air channel, and air in the first tube and the second tube is movable through the first air channel.

4. The portable pillow and blanket kit according to claim 2, wherein:

the pillow cover comprises a first pillow cover and a second pillow cover, the first air tube comprises a first type air tube arranged inside the first pillow cover and a second type air tube arranged inside the second pillow cover, the first pillow cover is capable of accommodating the second pillow cover therein, and the first pillow cover and the second pillow cover are formed to be different in size from each other.

5. The portable pillow and blanket kit according to claim 1, wherein the cover-shape changing member and the changing member detachable portion comprise hook and loop fasteners and are coupled to each other in a form of the hook and loop fasteners.

6. The portable pillow and blanket kit according to claim 1, wherein the cover-shape changing member comprises a first cover-shape changing member detachably coupled to a first area of the pillow cover, and a second cover-shape changing member detachably coupled to a second area of the pillow cover.

7. The portable pillow and blanket kit according to claim 1, wherein:

the pillow cover comprises a first pillow cover and a second pillow cover, the first pillow cover is capable of accommodating the second pillow cover therein, and the first pillow cover and the second pillow cover are formed to be different in size from each other.

8. The portable pillow and blanket kit according to claim 1, wherein:

the pillow cover comprises a pillow cover coupler for coupling with another portable pillow and blanket kit, and the pillow cover coupler is provided in singular or plural.

9. The portable pillow and blanket kit according to claim 1, wherein the pillow cover is made of an airproof material.

10. The portable pillow and blanket kit according to claim 1, wherein the opening/closing portion comprises an airproof opening/closing element.

11. The portable pillow and blanket kit according to claim 1, wherein the pillow cover comprises a pillow cover fastener configured to fasten the pillow cover to an external structure.

12. The portable pillow and blanket kit according to claim 1, wherein the pillow cover comprises a grip to be gripped by a user.

13. The portable pillow and blanket kit according to claim 1, wherein the pillow cover comprises a storage space.

14. A portable pillow and blanket kit comprising:

a pillow cover which comprises an opening/closing portion;

a blanket which is put into the pillow cover through the opening/closing portion;

a first air tube which is arranged inside the pillow cover;

a cover-shape changing member which comprises a first end portion coupled to the pillow cover, and a second end portion configured as a free end, which is detachably coupled to an outer surface of the pillow cover and making the pillow cover be changed in shape; and a cushion member which is penetrated by the cover-shape changing member, wherein the cover-shape changing member is configured to couple to and be separated from the cushion member, wherein the first air tube comprises a first air controller configured to inflate or deflate the first air tube, wherein the pillow cover comprises a changing member detachable portion on the outer surface thereof to which the second end portion of the cover-shape changing member is detachably coupled, wherein a single changing member insertion hole is formed in a middle of the cushion member, the cover-shape changing member configured to be inserted into the single changing member insertion hole, wherein the cover-shape changing member is configured to pass through the single changing member insertion hole so that the cover-shape changing member and the cushion member are coupled to each other, or the cover-shape changing member is configured to be separated from the cushion member upon removing the cushion member from the cover-shape changing member.

15. The portable pillow and blanket kit according to claim 14, wherein:

the first air tube comprises a first tube and a second tube, the first tube and the second tube are configured to at least partially communicate with each other through a first air channel, and air in the first tube and the second tube is movable through the first air channel.

16. The portable pillow and blanket kit according to claim 14, wherein:

the pillow cover comprises a first pillow cover and a second pillow cover, the first air tube comprises a first type air tube arranged inside the first pillow cover, and a second type air tube arranged inside the second pillow cover, the first pillow cover is capable of accommodating the second pillow cover therein, and the first pillow cover and the second pillow cover are formed to be different in size from each other.

17. The portable pillow and blanket kit according to claim 14, wherein the cover-shape changing member and the changing member detachable portion comprise hook and loop fasteners and are coupled to each other in a form of the hook and loop fasteners.

18. The portable pillow and blanket kit according to claim 14, wherein the cover-shape changing member comprises a first cover-shape changing member detachably coupled to a first area of the pillow cover, and a second cover-shape changing member detachably coupled to a second area of the pillow cover.

* * * * *